US008529095B2

(12) United States Patent
Konaka

(10) Patent No.: US 8,529,095 B2
(45) Date of Patent: Sep. 10, 2013

(54) BULB-SHAPED LED LAMP AND COMPACT LED LAMP

(75) Inventor: Daijiro Konaka, Yokohama (JP)

(73) Assignee: Osram Gesellschaft mit beschrankter Haftung, Munich (DE)

( * ) Notice: Subject to any disclaimer, the term of this patent is extended or adjusted under 35 U.S.C. 154(b) by 777 days.

(21) Appl. No.: 12/311,124

(22) PCT Filed: Sep. 19, 2007

(86) PCT No.: PCT/JP2007/068131

§ 371 (c)(1),
(2), (4) Date: May 6, 2009

(87) PCT Pub. No.: WO2008/035694

PCT Pub. Date: Mar. 27, 2008

(65) Prior Publication Data

US 2010/0002444 A1 Jan. 7, 2010

(30) Foreign Application Priority Data

Sep. 20, 2006 (JP) ..... 2006-253792

(51) Int. Cl.
*F21V 29/00* (2006.01)

(52) U.S. Cl.
USPC ..... 362/294; 362/227; 362/235; 362/240; 362/241; 362/246; 362/249.02; 362/341; 362/346

(58) Field of Classification Search
USPC ..... 362/294, 800, 227, 234, 235, 240, 362/241, 246, 249.02, 341, 342, 346, 363
See application file for complete search history.

(56) References Cited

U.S. PATENT DOCUMENTS

| | | | | |
|---|---|---|---|---|
| 4,261,030 | A * | 4/1981 | Hernandez | 362/296.01 |
| 4,774,637 | A * | 9/1988 | Budde et al. | 362/548 |
| 6,050,707 | A | 4/2000 | Kondo et al. | |
| 6,132,072 | A * | 10/2000 | Turnbull et al. | 362/494 |
| 6,450,661 | B1 * | 9/2002 | Okumura | 362/240 |
| 6,527,411 | B1 * | 3/2003 | Sayers | 362/245 |
| 6,621,222 | B1 * | 9/2003 | Hong | 315/51 |
| 6,840,654 | B2 * | 1/2005 | Guerrieri et al. | 362/241 |
| 6,864,513 | B2 | 3/2005 | Lin et al. | |

(Continued)

FOREIGN PATENT DOCUMENTS

| | | |
|---|---|---|
| JP | 02049008 A | 2/1990 |
| JP | 02164267 A | 6/1990 |

(Continued)

*Primary Examiner* — Mary McManmon

(74) *Attorney, Agent, or Firm* — Holtz, Holtz, Goodman & Chick, PC

(57) ABSTRACT

A bulb-shaped LED lamp includes a plurality of high-intensity LED modules 2 where a high-intensity LED is attached on an LED fixing base plate, a heat sink 5 where the high-intensity LED modules 2 are attached on an end face in an axial direction thereof along a circumferential direction, for performing radiation of the high-intensity LED modules 2, a reflector 4 which is provided so as to surround the plurality of high-intensity LED modules 2, for guiding light from the high-intensity LED modules 2 forward, an electronic circuit for driving 6 which drives the high-intensity LED modules 2, a housing 7 which houses the heat sink 5, the electronic circuit for driving 6, and a portion of the reflector 4 therein, and a globe 8 which configures an outer shell together with the housing 7.

2 Claims, 6 Drawing Sheets

(56) References Cited

U.S. PATENT DOCUMENTS

| | | | | |
|---|---|---|---|---|
| 6,971,772 | B1 * | 12/2005 | Abdelsamed et al. | 362/309 |
| 7,086,756 | B2 * | 8/2006 | Maxik | 362/249.04 |
| 7,095,562 | B1 * | 8/2006 | Peng et al. | 359/630 |
| 7,205,719 | B2 * | 4/2007 | Tain et al. | 313/512 |
| 7,237,936 | B1 * | 7/2007 | Gibson | 362/547 |
| 7,275,839 | B2 * | 10/2007 | Coushaine et al. | 362/231 |
| 7,278,839 | B2 * | 10/2007 | Liu et al. | 418/9 |
| 7,766,510 | B2 * | 8/2010 | Lee | 362/249.02 |
| 2002/0093820 | A1 * | 7/2002 | Pederson | 362/241 |
| 2003/0031015 | A1 * | 2/2003 | Ishibashi | 362/249 |
| 2003/0137838 | A1 | 7/2003 | Riskin et al. | |
| 2004/0208009 | A1 * | 10/2004 | Mardon et al. | 362/373 |
| 2004/0222516 | A1 * | 11/2004 | Lin et al. | 257/712 |
| 2005/0073244 | A1 | 4/2005 | Chou et al. | |
| 2005/0116597 | A1 | 6/2005 | Hsu | |
| 2005/0168985 | A1 * | 8/2005 | Chen | 362/241 |
| 2005/0174780 | A1 * | 8/2005 | Park | 362/294 |
| 2005/0254246 | A1 * | 11/2005 | Huang | 362/362 |
| 2006/0098440 | A1 * | 5/2006 | Allen | 362/294 |
| 2006/0176699 | A1 * | 8/2006 | Crunk | 362/294 |
| 2006/0227558 | A1 * | 10/2006 | Osawa et al. | 362/351 |
| 2007/0115655 | A1 * | 5/2007 | Kaminski et al. | 362/227 |
| 2008/0112170 | A1 * | 5/2008 | Trott et al. | 362/311 |
| 2009/0251882 | A1 * | 10/2009 | Ratcliffe | 362/84 |
| 2010/0053963 | A1 * | 3/2010 | Yang et al. | 362/249.02 |
| 2010/0124058 | A1 * | 5/2010 | Miller | 362/249.02 |

FOREIGN PATENT DOCUMENTS

| | | | |
|---|---|---|---|
| JP | 2003016805 | A | 1/2003 |
| JP | 2005-268600 | A | 9/2005 |
| JP | 2006-156187 | A | 6/2006 |
| JP | 2006-310057 | A | 11/2006 |
| JP | 2006-525648 | A | 11/2006 |
| JP | 2007-194132 | A | 8/2007 |
| WO | WO 2004/100213 | A2 | 11/2004 |
| WO | WO 2006/020535 | A2 | 2/2006 |
| WO | WO 2006/020535 | A3 | 2/2006 |

* cited by examiner

BULB-SHAPED LED LAMP AND COMPACT LED LAMP

TECHNICAL FIELD

The present invention relates to a bulb-shaped LED lamp and a compact LED lamp where light-emitting diodes (LEDs) are used as a light source.

BACKGROUND ART

In order to make luminance of light wavelength-converted by a wave-conversion cover approximately even and achieve a long operating life of fluorescence substance and light-emitting diode devices, there has been proposed a LED bulb provided with an LED light-emitting portion having a plurality of light-emitting diode devices for emitting near-ultraviolet light or blue light, which are arranged in a plane manner, a flat face portion disposed at a position spaced from a face on which the light-emitting diode devices are arranged by a predetermined distance so as to face the light-emitting diode devices, and a wavelength-converting cover provided on its flat face portion with fluorescence substance for wavelength-converting light emitted from the light-emitting diode devices (for example, see Patent Reference 1).

Patent Reference 1: JP-A-2006-156187

DISCLOSURE OF THE INVENTION

Problem to be Solved by the Invention

However, the LED lamp proposed above has the following problems.

Since a large amount of light emitted from the LED light-emitting portion of the LED bulb leaks from a glass globe laterally, it is impossible to take out light in a front direction efficiently.

The present invention has been made to solve the above-mentioned problems and an object thereof is to provide a bulb-shaped LED lamp which improves brightness and can obtain brightness corresponding to a filament bulb of 40 watts to 60 watts and a compact LED lamp.

Means for Solving the Problem

A bulb-shaped LED lamp according to the present invention comprises a plurality of high-intensity LED modules where a high-intensity LED is attached on an LED fixing base plate; a heat sink where the high-intensity LED modules are attached on one end face in an axial direction thereof along a circumferential direction, for performing radiation of the high-intensity LED modules; a reflector which is provided so as to surround the plurality of high-intensity LED modules, for guiding light from the high-intensity LED modules forward; an electronic circuit for driving which drives the high-intensity LED modules; a housing which houses the heat sink, the electronic circuit for driving, a portion of the reflector therein; and a globe which configures an outer shell together with the housing.

The bulb-shaped LED lamp according to the present invention has a configuration that a diffusion sheet is used as the reflector.

A bulb-shaped LED lamp according to the present invention comprises a plurality of high-intensity LED modules where a high-intensity LED is attached on an LED fixing base plate, each being provided around a high-intensity LED with a reflector for guiding light forward; a heat sink on which the high-intensity LED modules are attached on an end face in an axial direction thereof along a circumferential direction, for performing radiation of the high-intensity LED modules; an electronic circuit for driving which drives the high-intensity LED modules; a housing which houses the heat sink and the electronic circuit for driving; and a glass globe which configures an outer shell together with the housing.

A compact LED lamp according to the present invention comprises a plurality of high-intensity LED modules where a high-intensity LED is attached on an LED fixing base plate; a heat sink where the high-intensity LED modules are attached on an end face in an axial direction thereof along a circumferential direction, for performing radiation of the high-intensity LED modules; a reflector which is provided so as to surround the plurality of high-intensity LED modules, for guiding light from the high-intensity LED modules forward; a resin light-guiding blade member having the same number of blades as the number of high-intensity LED modules, where the blades are provided radially in a diametrical direction at approximately equal intervals, the blades have predetermined heights in the axial direction, and the respective blades are fixed on the high-intensity LED modules; an electronic circuit for driving which drives the high-intensity LED modules; and a housing which-houses the heat sink, the electronic circuit for driving, a portion of the reflector therein.

Effect of the Invention

With the abovementioned configuration, the bulb-shaped LED lamp according to the present invention can achieve such an effect that brightness is improved and brightness corresponding to a filament bulb of 40 watts to 60 watts can be obtained according to improvement of luminance of the high-intensity LEDs.

In the compact LED lamp according to the present invention, light from the high-intensity LED modules can be taken out laterally and forward efficiently by the resin light-guiding blade member having the same number of blades as the number of the high-intensity LED modules.

EXPLANATION OF REFERENCE NUMERALS

1: bulb-shaped LED lamp, 2: high-intensity LED module, 2*a*: high-intensity LED, 2*b*: LED fixing base plate, 2*c*: reflecting plate, 4: reflector, 5: heat sink, 6: electronic circuit for driving, 7: housing, 8: globe, 9: E26 base, 10: compact LED lamp, 11: resin light-guiding blade member, 11*a*: blade

BEST MODE FOR CARRYING OUT THE INVENTION

First Embodiment

Figure 1:
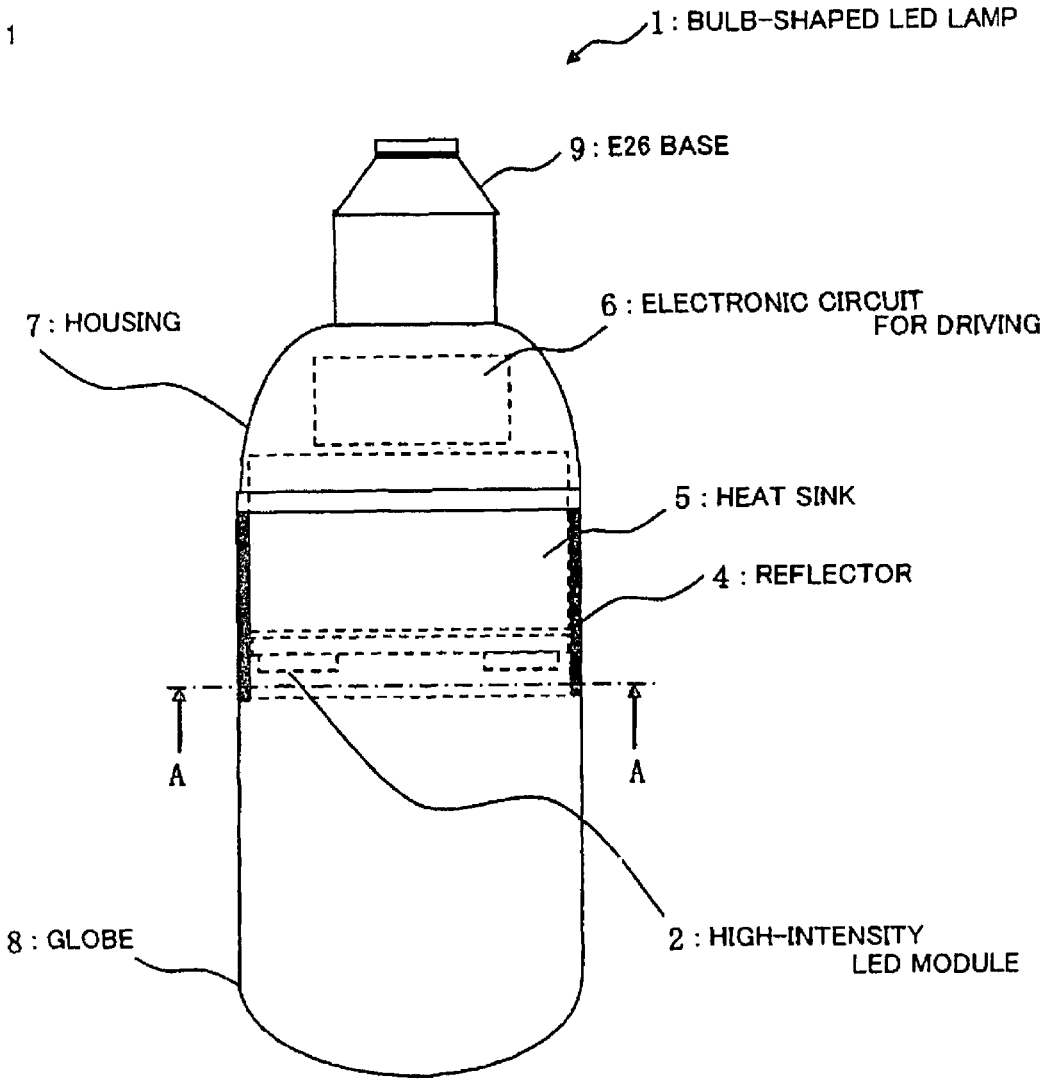
FIG. 1 shows a first embodiment and a front view of a bulb-shaped LED lamp 1.
Figure 2:
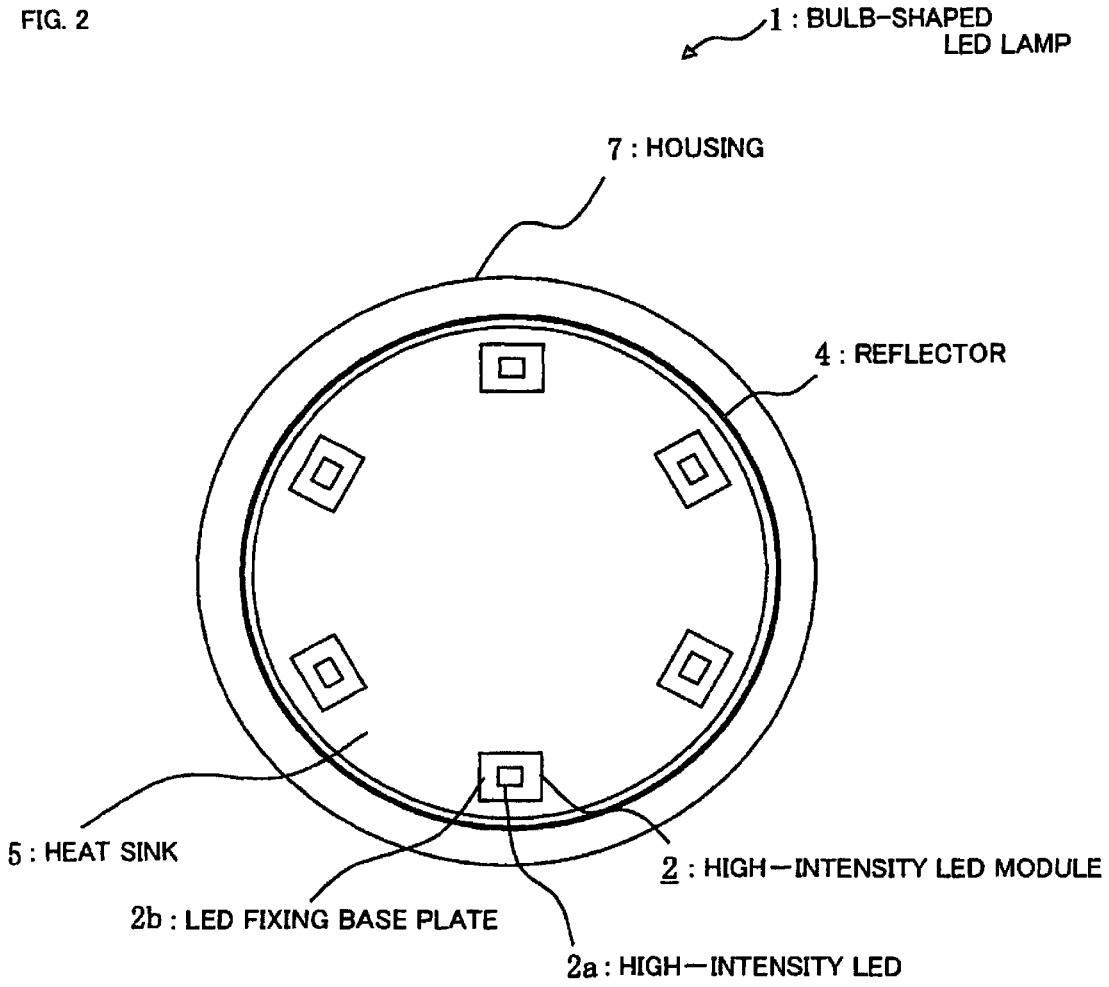
FIG. 2 shows the first embodiment and a sectional view taken along line A-A in FIG. 1.

FIG. 1 and FIG. 2 show a first embodiment. FIG. 1 shows a front view of a bulb-shaped LED lamp 1 and FIG. 2 shows a sectional view taken along line A-A in FIG. 1.

As shown in FIG. 1 and FIG. 2, a light source of the bulb-shaped LED lamp 1 is a high-intensity LED module 2 where a high-intensity LED 2*a* is attached on an LED fixing base plate 2*b*. Six high-intensity LED modules 2 are used here. Brightness of the high-intensity LED 2*a* has 20 lm (lumen) per one piece at present, and the brightness reaches only 120 lm even when six high-intensity LEDs are used, but it is expected that luminance of the high-intensity LED 2*a* is rapidly raised in the near future. For example, when the brightness of the high-intensity LED 2*a* reaches a value corresponding to 100 lm per one piece, illuminance corresponding to a filament bulb of 40 to 60 watts is obtained under such a condition that a distance between a subject and the bulb-shaped LED lamp 1 is in a range of 1 m to 2 m and a distance in circumferential direction is about 2 m by the bulb-shaped LED lamp 1 of a configuration in FIG. 1 and FIG. 2.

Six high-intensity LED modules 2 are arranged and fixed on an end face of a heat sink 5 in an axial direction thereof along a circumferential direction. LED fixing base plates 2*b* are fixed on the heat sink 5 by adhesive or the like. The LED fixing base plate 2*b* is made from metal, polyimide resin, or the like. The heat sink 5 is a radiator plate made from, for example, aluminum, and heat generated from the high-intensity LED module 2 is transmitted and radiated efficiently.

A housing 7 is provided so as to surround the heat sink 5. The housing 7 is made from PBT (polybutylene terephthalate) resin or such metal as aluminum. The housing 7 is provided therein with not only the heat sink 5 but also an electronic circuit for driving 6 that adjusts power taken in from an external power source to current/voltage for lighting each high-intensity LED 2*a* to supply the same to each high-intensity LED 2*a*. Since the electronic circuit for driving 6 is a known one, explanation thereof is omitted.

The respective high-intensity LED modules 2 are surrounded by a reflector 4 optimized for efficiently taking out light from each high-intensity LED 2*a* forward. The reflector 4 is made of, for example, a diffusion sheet made from polycarbonate (PC), molded resin, or metal such as stainless steel. Lateral leakage of light from the high-intensity LEDs 2*a* is suppressed by the reflector 4, so that light can be efficiently taken out forward.

A globe 8 is attached to the outside of the reflector 4, and it configures an outer shell of a bulb-shaped LED lamp together with the housing 7. Material of the globe 8 is resin, glass, or the like. The housing 7 is attached with an E26 base. An E17 base may be used instead of the E26 base.

When the housing 7 is made from resin, radiation from resin surface is insufficient, so that thermally-conductive silicon rubber is filled in the housing 7, thereby coupling the heat sink 5 and the E26 base 9 thermally.

As described above, since the bulb-shaped LED lamp 1 according to the present embodiment uses the high-intensity LED modules 2, where light can be taken out forward efficiently by the reflector 4 suppressing lateral leakage of light from the high-intensity LEDs 2*a*, it is expected that, when luminance of a high-intensity LED2*a* is raised in the future, illuminance corresponding to a filament bulb of 40 to 60 watts can be obtained under such a condition that a distance between a subject and the bulb-shaped LED lamp 1 is in a range of 1 m to 2 m and a distance in a circumferential direction is about 2 m.

Second Embodiment

Figure 3:
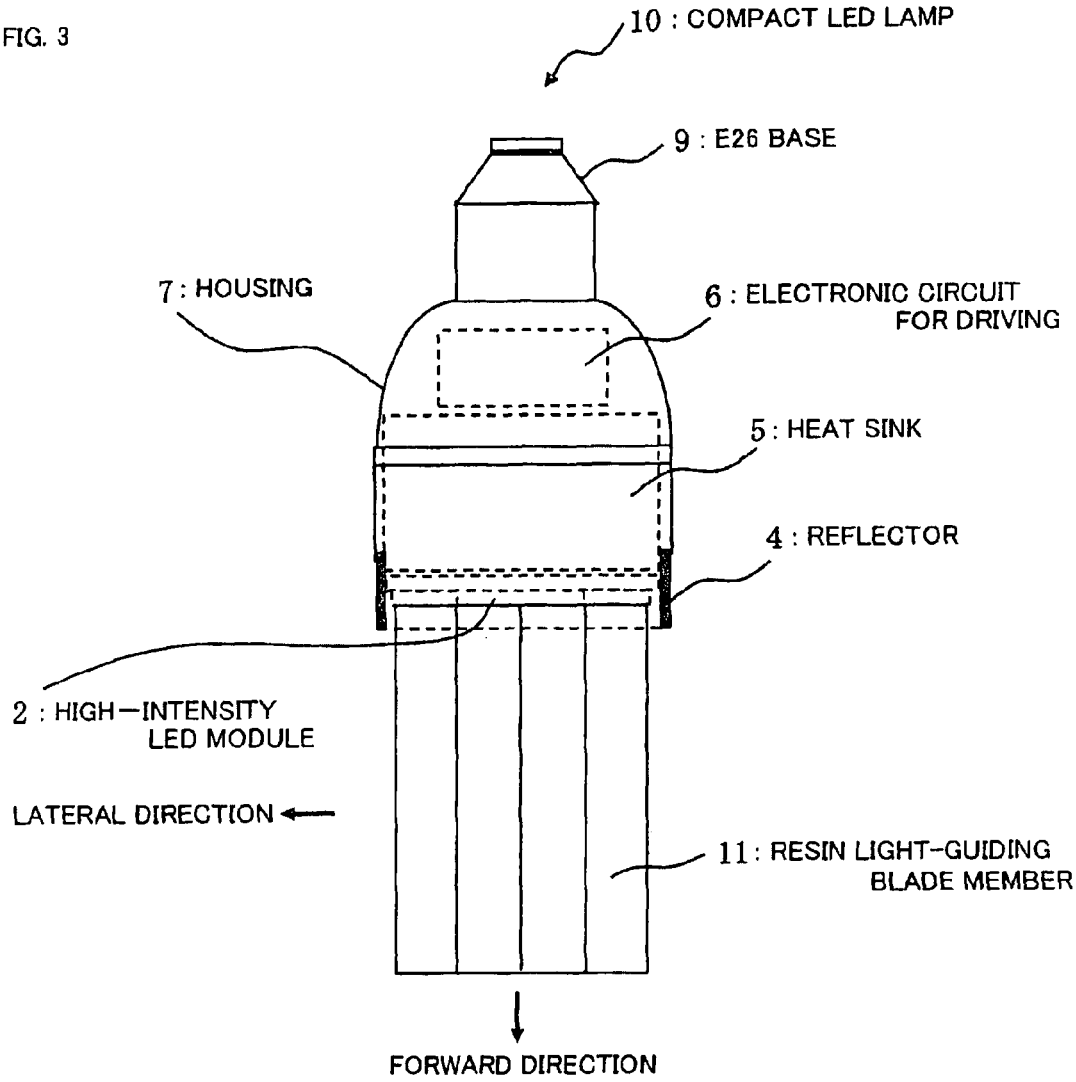
FIG. 3 shows a second embodiment and a front view of a compact LED lamp 10.
Figure 4:
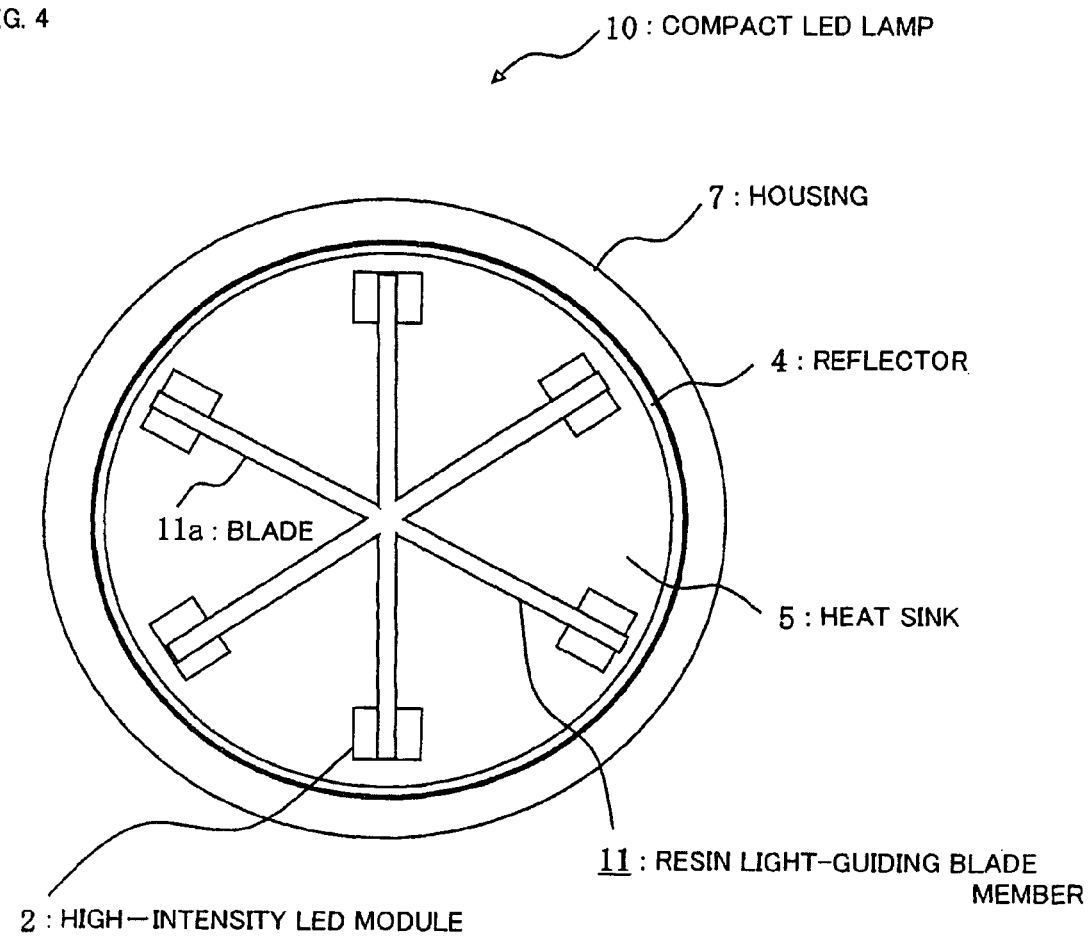
FIG. 4 shows the second embodiment and a plan view of the compact LED 10 lamp viewed from the front thereof.

FIG. 3 and FIG. 4 show a second embodiment. FIG. 3 shows a front view of a compact LED lamp 10 and FIG. 4 shows a plan view of the compact LED lamp 10 viewed from the front thereof.

The compact LED lamp 10 is different from the bulb-shaped LED lamp 1 in FIG. 1 in that the former does not have the globe 8 and it is provided with a resin light-guiding blade member 11. The other configuration of the second embodiment is the same as that of the first embodiment.

The resin light-guiding blade member 11 has six blades 11*a* as shown in FIG. 4, where the blades 11*a* are provided radially in a diametrical direction at almost equal intervals. The blades 11*a* are set to predetermined heights in an axial direction (a height direction). Each blade 11*a* is bonded and fixed on the high-intensity LED module 2. Light from the high-intensity LED modules 2 is guided efficiently by the resin light-guiding blade member 11 so that light can be taken out in a lateral direction (a diametrical direction) and in a forward direction. The resin light-guiding blade member 11 serves to diffuse light from the high-intensity LED modules 2 properly and serves to guide the light.

As described above, the compact LED lamp 10 according to the present embodiment can take out light from the high-intensity LED modules 2 in a lateral direction and a forward direction by the resin light-guiding blade member 11 having the same number of blades as the number of high-intensity LED modules 2.

Third Embodiment

Figure 5:
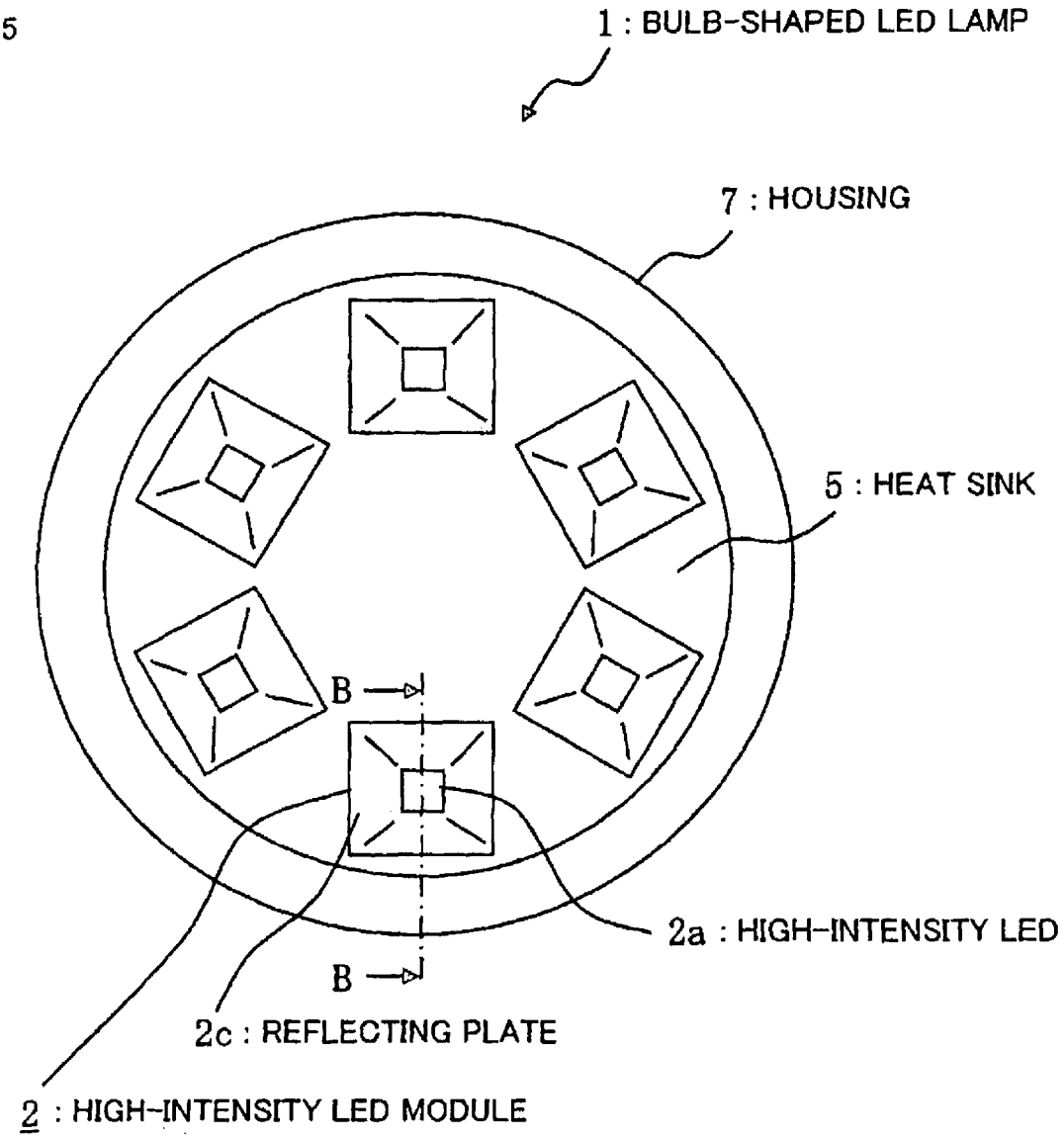
FIG. 5 shows a third embodiment and a plan view of a bulb-shaped LED lamp 1.
Figure 6:
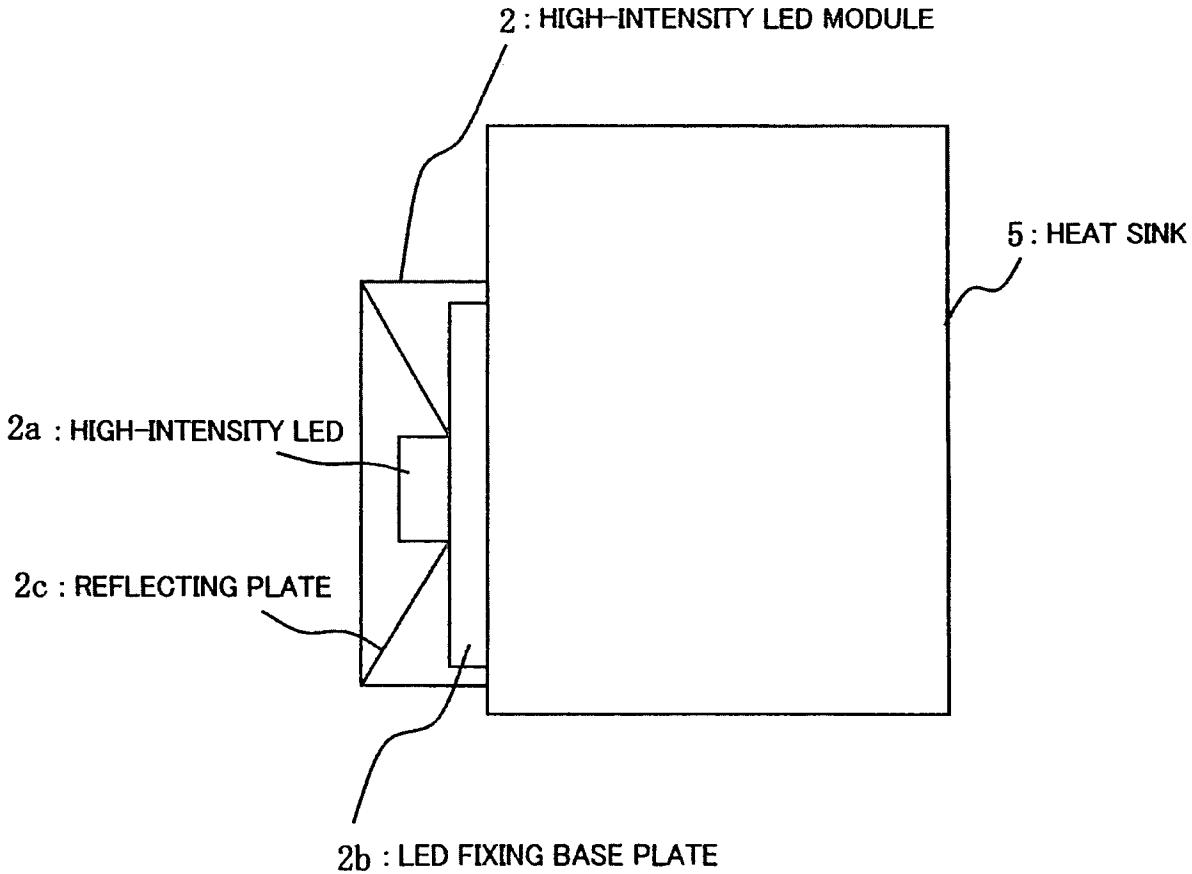
FIG. 6 shows the third embodiment and a sectional view taken along line B-B in FIG. 5.

FIG. 5 and FIG. 6 show a third embodiment. FIG. 5 shows a plan view of a bulb-shaped LED lamp 1 and FIG. 6 shows a sectional view taken along line B-B in FIG. 5.

In the first embodiment, the reflector 4 is provided so as to surround all of the high-intensity LED modules 2, but reflecting plates 2*c* may be provided for individual high-intensity LED modules 2 instead of the reflector 4.

As shown in FIG. 5, six high-intensity LED modules 2 each have a horn-shaped reflecting plate 2*c* for guiding light forward around the high-intensity LED 2*a*. Since each high-intensity LED module 2 has the reflecting plate 2*c* for guiding light forward, the reflector 4 may be removed.

As shown in FIG. 6, in the high-intensity LED module 2, the high-intensity LED 2*a* is provided on the LED fixing base plate 2*b* and the horn-shaped reflecting plate 2*c* is provided around the high-intensity LED 2*a*. The LED fixing base plate 2*b* is bonded and fixed to the heat sink 5 by, for example, a double-faced adhesive tape.

As described above, in the bulb-shaped LED lamp 1 according to the present embodiment, the horn-shaped reflecting plates 2*c* for guiding light forward are provided around the high-intensity LEDs 2*a* of the individual high-intensity LED modules 2, thereby the reflector 4 used in the first embodiment can be removed.

However, both the horn-shaped reflecting plates 2*c* for guiding light forward provided around the high-intensity LEDs 2*a* of the individual high-intensity LED modules 2 and the reflector 4 surrounding all of the high-intensity LED modules 2 may be used.

The invention claimed is:

1. A compact LED lamp comprising:

a plurality of high-intensity LED modules each comprising a high-intensity LED attached to an LED fixing base plate;

a heat sink, the high-intensity LED modules extending from a first face of the heat sink at predetermined radial intervals around a circumferential direction of the heat sink, the heat sink performing heat radiation of heat generated by the high-intensity LED modules;

a reflector surrounding the plurality of high-intensity LED modules so as to guide light from the high-intensity LED modules in a forward direction, wherein the reflector comprises a diffusion sheet;

a resin light-guiding blade member having a same number of blades as a number of high-intensity LED modules, the blades being provided radially in a diametrical direction at substantially equal intervals, the blades having predetermined heights in an axial direction, and the blades being fixed on the high-intensity LED modules;

an electronic circuit which drives the high-intensity LED modules; and a housing which houses the heat sink, the electronic circuit, and a portion of the reflector therein, the reflector extending to at least a same height above the heat sink in an axial direction of the lamp as a height to which the plurality of high-intensity LED modules extend.

2. The compact LED lamp according to claim 1, wherein the reflector comprises a diffusion sheet.

* * * * *